US007934477B2

(12) United States Patent
Elnick et al.

(10) Patent No.: US 7,934,477 B2
(45) Date of Patent: May 3, 2011

(54) ROCKER ARM ASSEMBLY

(75) Inventors: Rodney K. Elnick, Washington, MI (US); Michael Smith, Hinsdale, NH (US)

(73) Assignee: GM Global Technology Operations LLC, Detroit, MI (US)

( * ) Notice: Subject to any disclaimer, the term of this patent is extended or adjusted under 35 U.S.C. 154(b) by 458 days.

(21) Appl. No.: 12/197,595

(22) Filed: Aug. 25, 2008

(65) Prior Publication Data

US 2010/0043737 A1 Feb. 25, 2010

(51) Int. Cl.
*F01L 1/34* (2006.01)

(52) U.S. Cl. ..... 123/90.16; 123/90.44

(58) Field of Classification Search ..... 123/90.16, 123/90.39, 90.44, 90.45, 90.42, 90.41
See application file for complete search history.

(56) References Cited

U.S. PATENT DOCUMENTS 5,239,952 A * 8/1993 Morita ..... 123/90.16
6,769,387 B2 * 8/2004 Hayman et al. ..... 123/90.39
6,976,461 B2 * 12/2005 Rorig et al. ..... 123/90.16
6,997,152 B2 * 2/2006 Harris ..... 123/90.39
7,278,384 B2 * 10/2007 Fernandez et al. ..... 123/90.16
7,308,872 B2 * 12/2007 Sellnau et al. ..... 123/90.16
7,798,113 B2 * 9/2010 Fischer et al. ..... 123/90.44

* cited by examiner

*Primary Examiner* — Thomas E Denion
*Assistant Examiner* — Daniel A Bernstein
(74) *Attorney, Agent, or Firm* — Harness, Dickey & Pierce, P.L.C.

(57) ABSTRACT

An engine assembly may include an engine structure, a rocker arm assembly supported by the engine structure, a camshaft rotatably supported on the engine structure and engaged with the rocker arm assembly, and a valve member engaged with the rocker arm assembly. The rocker arm assembly may include a lever body having a first end engaged with the valve member and a second end defining a pivot point and having an opening therethrough, an arm assembly including a first end rotatably coupled to the first end of the lever body and a second end including a latch, and a locking mechanism located within the opening in the lever body and including a latch pin having a recess therein and a guide holder including a finger extending into the recess preventing rotation of the latch pin relative to the guide holder.

20 Claims, 4 Drawing Sheets

ROCKER ARM ASSEMBLY

FIELD

The present disclosure relates to rocker arm assemblies, and more specifically to a latch pin of a multi-step rocker arm assembly.

BACKGROUND

The statements in this section merely provide background information related to the present disclosure and may not constitute prior art.

Engine valve train assemblies may include rocker arms capable of providing multiple valve lift durations. The rocker arms typically include some form of hydraulically actuated locking mechanism that provides actuation between various lift modes. These locking mechanisms can be difficult to orient and may provide complicated assembly processes resulting in increased assembly times and additional cost.

SUMMARY

An engine assembly may include an engine structure, a rocker arm assembly supported by the engine structure, a camshaft rotatably supported on the engine structure, and a valve member. The engine structure may include an engine block and a cylinder head mounted to the engine block. The rocker arm assembly may include a lever body having a first end and a second end defining a pivot point and having an opening therethrough, an arm assembly including a first end rotatably coupled to the first end of the lever body and a second end including a latch, and a locking mechanism located within the opening in the lever body and including a latch pin having a recess therein and a guide holder including a finger extending into the recess preventing rotation of the latch pin relative to the guide holder. The latch pin may be axially displaceable between a first position where the latch is engaged with the latch pin to provide rotation of the lever body with the arm assembly and a second position where the latch is disengaged from the latch pin to provide relative rotation between the arm assembly and the lever body. The camshaft may include a first lobe engaged with the arm assembly and a second lobe engaged with the lever body. The valve member may be located in the cylinder head and engaged with the first end of the lever body. The first lobe may displace the valve member a first distance when the latch pin is in the first position. The first lobe may displace the arm assembly relative to the lever body and the second lobe may displace the valve member a second distance less than the first distance when the latch pin is in the second position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
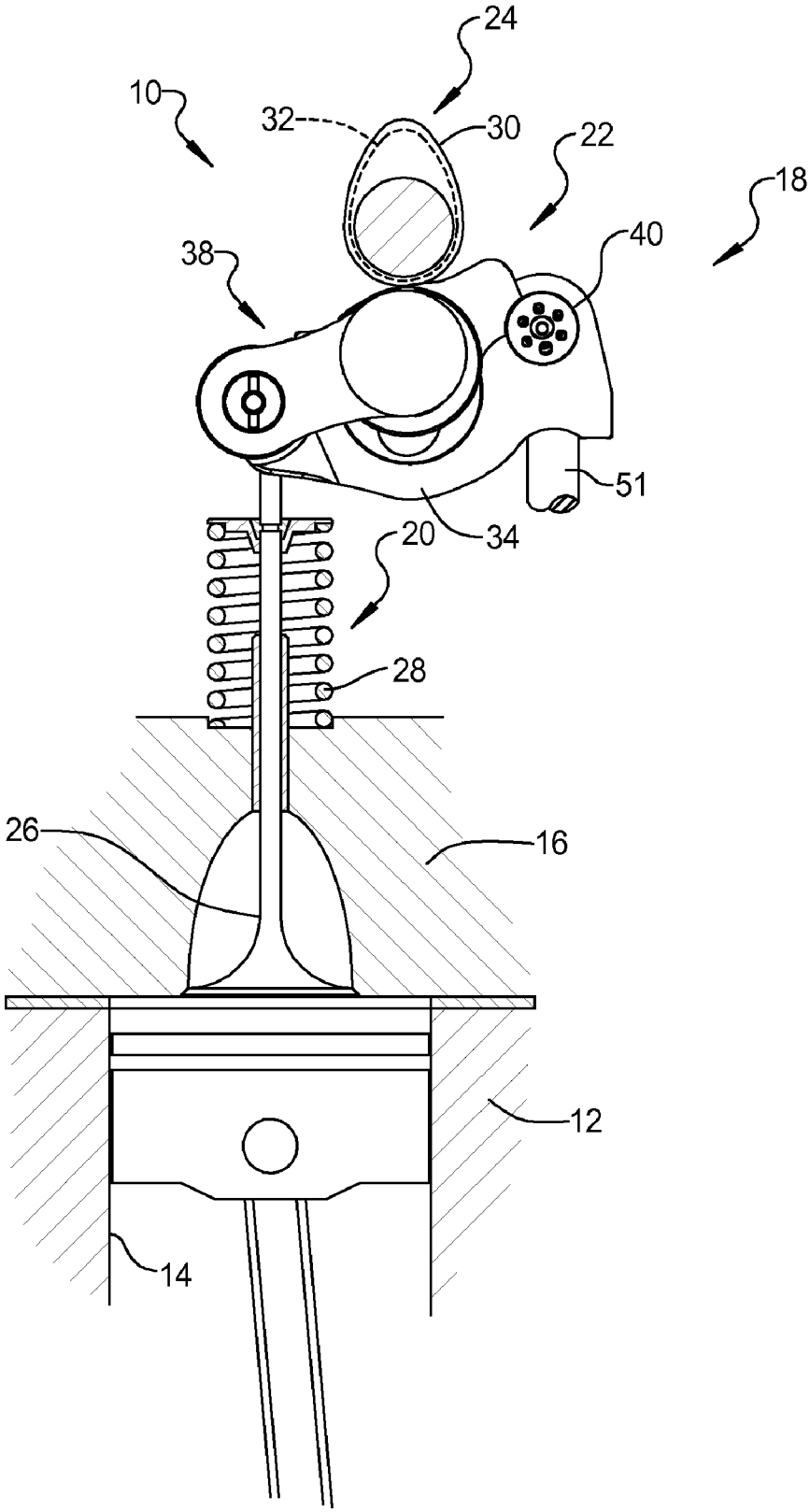
FIG. 1 is a schematic illustration of an engine assembly according to the present disclosure.

The following description is merely exemplary in nature and is not intended to limit the present disclosure, application, or uses. It should be understood that throughout the drawings, corresponding reference numerals indicate like or corresponding parts and features.

With reference to FIG. 1, an engine assembly 10 is illustrated. The engine assembly 10 may have an engine structure including an engine block 12 defining a plurality of cylinders 14 (one of which is shown), a cylinder head 16 mounted to the engine block 12 and overlying the cylinders 14, and a valve train 18. The valve train 18 may be coupled to a portion of the engine structure such as the cylinder head 16.

The valve train 18 may include a valve assembly 20, a rocker arm assembly 22, and a camshaft 24. The valve assembly 20 may include a valve member 26 and a biasing member 28. The biasing member 28 may include a compression spring and may bias the valve member 26 to a closed position. The rocker arm assembly 22 may be pivotally coupled to the engine structure. The camshaft 24 may include a set of first lobes 30 (one of which is shown) and a second lobe 32 engaged with the rocker arm assembly 22 to displace the valve member 26.

Figure 4:
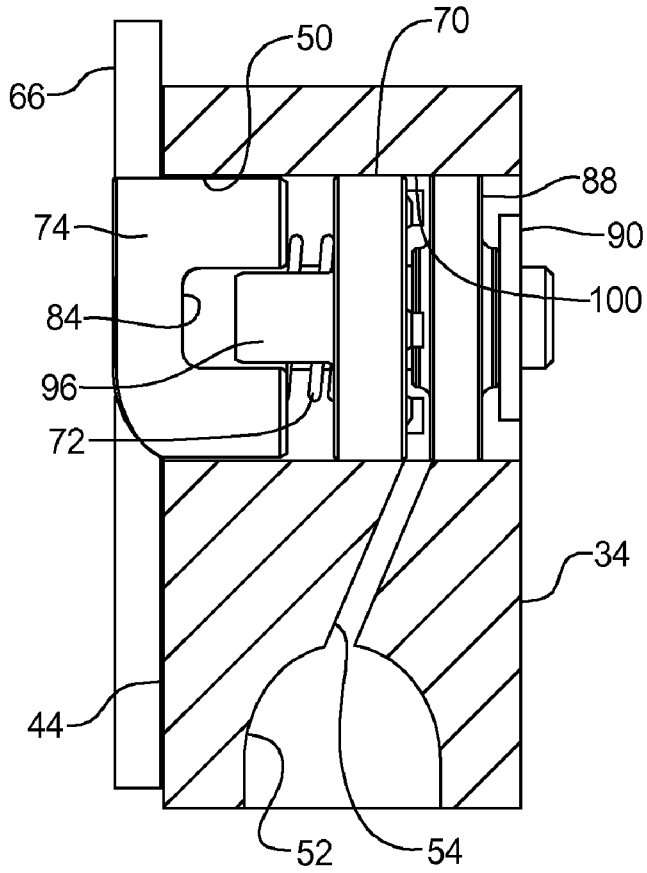
FIG. 4 is a partial section view of the rocker arm assembly of FIG. 2.
Figure 5:
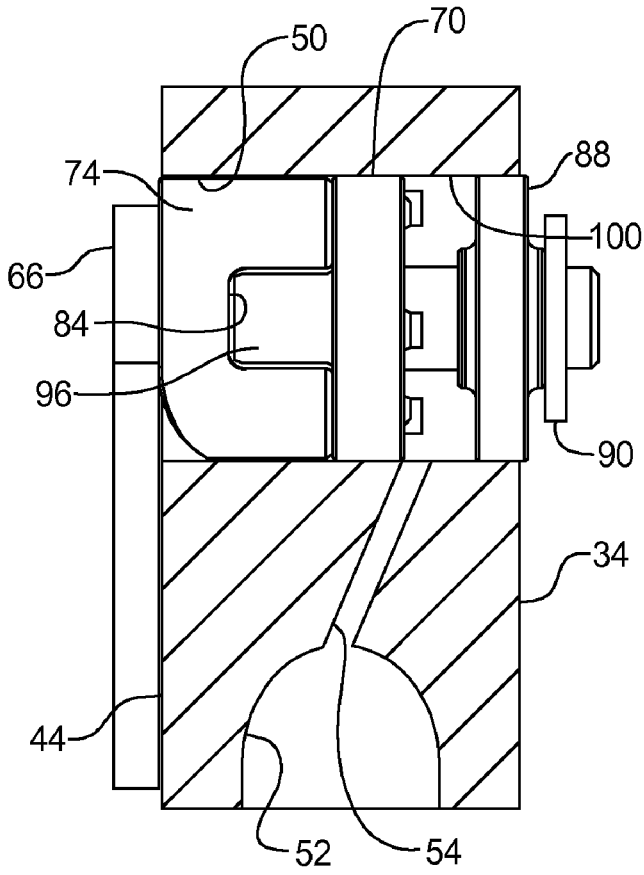
FIG. 5 is an additional partial section view of the rocker arm assembly of FIG. 2.

The rocker arm assembly 22 may be a multi-step rocker arm assembly, for example, a two-step rocker arm assembly. With additional reference to FIG. 2, the rocker arm assembly 22 may include a lever body 34, a first roller assembly 36, an arm assembly 38, and a locking mechanism 40. The lever body 34 may include a first end 42, a second end 44, and a medial portion 46 located between the first and second ends 42, 44. The first end 42 may include a first opening 48. With reference to FIGS. 4 and 5, the second end 44 may include a second opening 50, a recess 52, and an oil passage 54 in communication with the second opening 50 and the recess 52. The first end 42 may be engaged with the valve assembly 20 for actuation of the valve member 26. The recess 52 in the second end 44 may be engaged with and pivotally supported by a support member 51. The recess 52 may be in communication with a pressurized oil source from a valve train component. For example, the support member 51 may include a hydraulic lash adjuster and the lash adjuster may provide pressurized oil to the recess 52. The first roller assembly 36 may be fixed for pivotal displacement with the lever body 34 at the medial portion 46.

Figure 2:
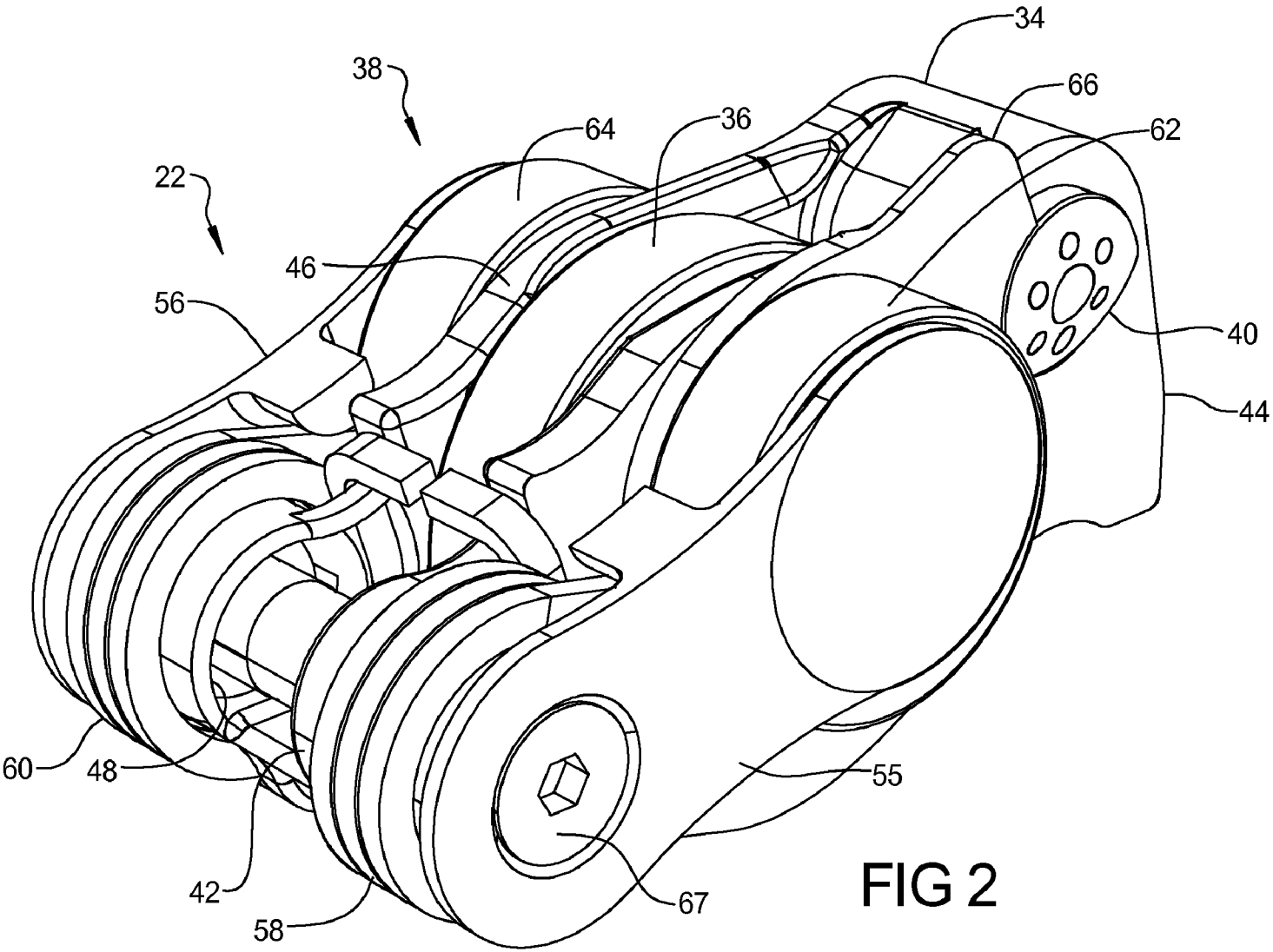
FIG. 2 is a perspective view of a rocker arm assembly shown in FIG. 1.

As seen in FIG. 2, the arm assembly 38 may include first and second arms 55, 56, first and second biasing members 58, 60, second and third roller assemblies 62, 64, a latch 66, and a fastener 67. The fastener 67 may extend through first ends of the first and second arms 55, 56 and the first opening 48 in the lever body 34 to pivotally couple the arm assembly 38 to the lever body 34. The second roller assembly 62 may be coupled to a second end of the first arm 55 and the third roller assembly 64 may be coupled to a second end of the second arm 56. The first and second arms 55, 56, the second and third roller assemblies 62, 64, and the latch 66 may each be fixed for pivotal displacement with one another. The first biasing member 58 may be engaged with the first arm 55 and the lever body 34 and the second biasing member 60 may be engaged with the second arm 56 and the lever body 34. The first and second biasing members 58, 60 may include torsion springs and may bias the arm assembly 38 against the first lobes 30.

Figure 3:
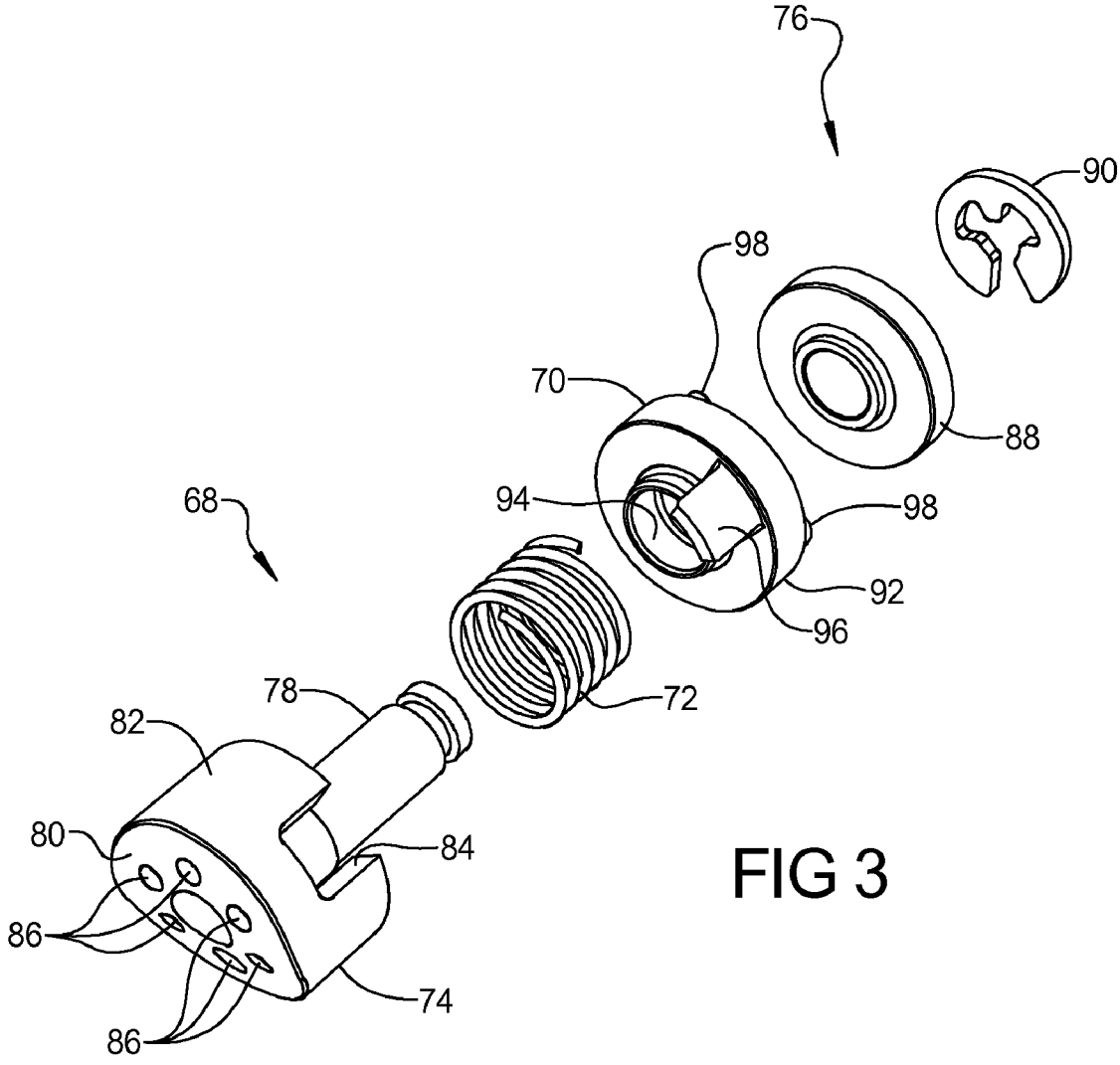
FIG. 3 is a perspective exploded view of a latch pin of the rocker arm assembly of FIG. 2.

With reference to FIGS. 3-5, the locking mechanism 40 may be located in the second opening 50 of the lever body 34 and may include a latch pin 68, a guide holder 70, and a biasing member 72. The latch pin 68 may include first and second portions 74, 76 and a connecting portion 78 extending between and coupled to the first and second portions 74, 76. The first portion 74 may include an outer axial face 80 and an outer circumferential surface 82. The outer circumferential surface 82 may include a recess 84 and the outer axial face 80 may include a series of apertures 86. The connecting portion 78 may extend axially from the first portion 74 of the latch pin 68. The second portion 76 of the latch pin 68 may include a latch retainer 88 and a latch clip 90. The latch clip 90 may be axially fixed to the connecting portion 78 and may retain the latch retainer 88 on the connecting portion 78.

The guide holder 70 may include a body portion 92 having a central aperture 94, an axially extending finger 96 on a first axial side of the guide holder 70, and a series of axially extending stops 98 on a second axial side of the guide holder 70. The connecting portion 78 of the latch pin 68 may extend through the central aperture 94 of the guide holder 70 and the first portion 74 of the latch pin 68 may be located on the first axial side of the guide holder 70. The second portion 76 of the latch pin 68 may be located on the second axial side of the guide holder 70. Therefore, the guide holder 70 may be retained axially between the first and second portions 74, 76 of the latch pin 68 before the locking mechanism is installed within the second opening 50 of the lever body 34. The finger 96 on the guide holder 70 may extend into the recess 84 in the latch pin 68 to rotationally fix the latch pin 68 relative to the guide holder 70 and guide axial displacement of the latch pin 68 relative to the guide holder 70.

The biasing member 72 may include a compression spring extending around the connecting portion 78 of the latch pin 68 and may be located axially between and engaged with the first portion 74 of the latch pin 68 and the guide holder 70. As such, the locking mechanism 40 may form a subassembly where the latch pin 68, the guide holder 70, and the biasing member 72 are coupled to one another and the latch pin 68 is rotationally oriented relative to the guide holder 70 before the locking mechanism 40 is located in the second opening 50 of the lever body 34.

When locating the locking mechanism 40 within the lever body 34, the apertures 86 in the latch pin 68 may be used to orient the locking pin mechanism 40. For example, one of the apertures 86 may be larger than the remaining apertures 86 to provide an orientation feature for the locking mechanism 40. As indicated above, the locking mechanism 40 may form a subassembly before insertion into the lever body 34. The apertures 86 may therefore provide for orientation of the subassembly formed by the assembled locking mechanism 40 within the second opening 50 of the lever body 34.

As seen in FIGS. 4 and 5, the locking mechanism 40 may be fixed within the second opening 50 of the lever body 34 by a frictional engagement between the guide holder 70 and the lever body 34. An oil chamber 100 may be formed within the second opening 50 of the lever body 34 between the guide member 70 and the second portion 76 of latch pin 68. More specifically, the oil chamber 100 may be formed between the second side of the guide holder 70 and the latch retainer 88. The oil chamber 100 may be in communication with the oil passage 54 in the lever body 34. The guide holder 70 may be axially fixed relative to the lever body 34 and the latch pin 68 may be axially displaceable between a first position (FIG. 4) and a second position (FIG. 5) relative to the guide holder 70 and the lever body 34 by a pressurized oil supplied to the oil chamber 100 from the oil passage 54. When the latch pin 68 is displaced from the second position to the first position, oil within the oil chamber 100 may be exhausted through a clearance between the connecting portion 78 of the latch pin 68 and the central aperture 94 of the guide holder 70. The oil may then exit the second opening 50 and the latch pin 68 through the apertures 86 in the latch pin 68.

During operation, the rocker arm assembly 22 may be switched between first and second lift modes by actuating the latch pin 68. In the first lift mode, the latch pin 68 is in the first position shown in FIG. 4. In the first lift mode, the latch 66 is engaged with the latch pin 68, coupling the arm assembly 38 for pivotal displacement with the lever body 34. Therefore, when the first lobes 30 of the camshaft 24 engage the second and third roller assemblies 62, 64, the lever body 34 is pivotally displaced and the valve member 26 is opened.

In the second lift mode, the latch pin 68 is in the second position shown in FIG. 5. In the second position, the latch pin 68 is located axially inwardly relative to the first position and the latch 66 is free from engagement with the latch pin 68. Therefore, when the first lobes 30 of the camshaft 24 engage the second and third roller assemblies 62, 64, the arm assembly 38 is pivotally displaced relative to the lever body 34. The second lobe 32 of the camshaft 24 engages the first roller assembly 36 and pivotally displaces the lever body 34 to open the valve member 26. The first lift mode may generally provide for a greater opening duration and a higher lift of the valve member 26 relative to the second lift mode.

The latch pin 68 may be actuated between the first and second positions based on the oil pressure supplied to the oil chamber 100. When the oil pressure within oil chamber 100 is below a predetermined limit, the latch pin may be held in the first position by the force applied by the biasing member 72. When the oil pressure within the oil chamber 100 exceeds the predetermined limit, the latch pin 68 may be displaced to the second position. When the oil pressure within the oil chamber 100 exceeds the predetermined limit, the force resulting from the pressurized oil acting on the latch retainer 88 may be greater than the force applied to the latch pin 68 by the biasing member 72. Therefore, the latch pin 68 is displaced axially inwardly to the second position. The oil pressure supplied to the oil chamber 100 may be controlled in a variety of ways including, but not limited to, an oil control valve (not shown).

What is claimed is:

1. A multi-step rocker arm assembly comprising:

a lever body having a first end adapted to engage a valve member and a second end defining a pivot point, the second end including an opening therethrough;

an arm assembly including a first end rotatably coupled to the first end of the lever body and a second end including a latch; and a locking mechanism located within the opening in the lever body and including a latch pin having a recess therein and a guide holder including a finger extending into the recess preventing rotation of the latch pin relative to the guide holder, the latch pin being axially displaceable between a first position where the latch is engaged with the latch pin to provide rotation of the lever body with the arm assembly and a second position where the latch is disengaged from the latch pin to provide relative rotation between the arm assembly and the lever body.

2. The multi-step rocker arm assembly of claim 1, wherein the guide holder is rotationally and axially fixed within the opening in the lever body.

3. The multi-step rocker arm assembly of claim 1, wherein the guide holder includes a main body portion having an aperture extending therethrough, the latch pin includes a first portion located on a first axial side of the guide holder, a second portion located on a second axial side of the guide holder generally opposite the first axial side and a connecting portion fixed to the first and second portions and extending through the aperture in the guide holder.

4. The multi-step rocker arm assembly of claim 3, wherein the guide holder is retained axially between the first and second portions of the latch pin prior to insertion into the opening in the lever body.

5. The multi-step rocker arm assembly of claim 3, wherein an oil chamber is defined by the opening in the lever body between the second axial side of the guide holder and the second portion of the latch pin.

6. The multi-step rocker arm assembly of claim 5, wherein the first portion of the latch pin is displaced axially toward the first axial side of the guide holder and the second portion of the latch pin is displaced axially outward relative to the second axial side of the guide holder when the latch pin is displaced from the first position to the second position.

7. The multi-step rocker arm assembly of claim 6, wherein the latch pin is displaced from the first position to the second position by a pressurized oil within the oil chamber acting on the second portion of the latch pin.

8. The multi-step rocker arm assembly of claim 7, further comprising a biasing member located between the first axial side of the guide holder and the first portion of the latch pin, the biasing member urging the first portion of the latch pin axially outward relative to the first axial side of the guide holder.

9. The multi-step rocker arm assembly of claim 8, wherein the biasing member returns the latch pin from the second position to the first position, the pressurized oil within the oil chamber being forced through a clearance between the aperture in the guide holder and the connecting portion of the latch pin when the latch pin is displaced from the second position to the first position.

10. The multi-step rocker arm assembly of claim 4, wherein the first portion of the latch pin includes first and second apertures extending through an outer axial surface thereof to orient the latch pin within the opening in the lever body.

11. An engine assembly comprising:

an engine structure including an engine block and a cylinder head mounted to the engine block;

a rocker arm assembly supported by the engine structure and including:

a lever body having a first end and a second end defining a pivot point and having an opening therethrough;

an arm assembly including a first end rotatably coupled to the first end of the lever body and a second end including a latch; and a locking mechanism located within the opening in the lever body and including a latch pin having a recess therein and a guide holder including a finger extending into the recess preventing rotation of the latch pin relative to the guide holder, the latch pin being axially displaceable between a first position where the latch is engaged with the latch pin to provide rotation of the lever body with the arm assembly and a second position where the latch is disengaged from the latch pin to provide relative rotation between the arm assembly and the lever body;

a camshaft rotatably supported on the engine structure and including a first lobe engaged with the arm assembly and a second lobe engaged with the lever body; and a valve member located in the cylinder head and engaged with the first end of the lever body, the first lobe displacing the valve member a first distance when the latch pin is in the first position, the first lobe displacing the arm assembly relative to the lever body and the second lobe displacing the valve member a second distance less than the first distance when the latch pin is in the second position.

12. The engine assembly of claim 11, wherein the guide holder is rotationally and axially fixed within the opening in the lever body.

13. The engine assembly of claim 11, wherein the guide holder includes a main body portion having an aperture extending therethrough, the latch pin includes a first portion located on a first axial side of the guide holder, a second portion located on a second axial side of the guide holder generally opposite the first axial side and a connecting portion fixed to the first and second portions and extending through the aperture in the guide holder.

14. The engine assembly of claim 13, wherein the guide holder is retained axially between the first and second portions of the latch pin prior to insertion into the opening in the lever body.

15. The engine assembly of claim 13, wherein an oil chamber is defined by the opening in the lever body between the second axial side of the guide holder and the second portion of the latch pin.

16. The engine assembly of claim 15, wherein the first portion of the latch pin is displaced axially toward the first axial side of the guide holder and the second portion of the latch pin is displaced axially outward relative to the second axial side of the guide holder when the latch pin is displaced from the first position to the second position.

17. The engine assembly of claim 16, wherein the latch pin is displaced from the first position to the second position by a pressurized oil within the oil chamber acting on the second portion of the latch pin.

18. The engine assembly of claim 17, further comprising a biasing member located between the first axial side of the guide holder and the first portion of the latch pin, the biasing member urging the first portion of the latch pin axially outward relative to the first axial side of the guide holder.

19. The engine assembly of claim 18, wherein the biasing member returns the latch pin from the second position to the first position, the pressurized oil within the oil chamber being forced through a clearance between the aperture in the guide holder and the connecting portion of the latch pin when the latch pin is displaced from the second position to the first position.

20. The engine assembly of claim 14, wherein the first portion of the latch pin includes first and second apertures extending through an outer axial surface thereof to orient the latch pin within the opening in the lever body.

* * * * *